US009079187B2

(12) United States Patent
Ballestra

(10) Patent No.: US 9,079,187 B2
(45) Date of Patent: Jul. 14, 2015

(54) MACERATOR DEVICE INTENDED TO BE CONNECTED TO A WC BOWL

(75) Inventor: Jean Victor Ballestra, Paris (FR)

(73) Assignee: SOCIETE FRANCAISE D'ASSAINISSEMENT-SFA, Paris (FR)

( * ) Notice: Subject to any disclaimer, the term of this patent is extended or adjusted under 35 U.S.C. 154(b) by 531 days.

(21) Appl. No.: 13/321,251

(22) PCT Filed: May 12, 2011

(86) PCT No.: PCT/FR2011/051068

§ 371 (c)(1),
(2), (4) Date: Feb. 10, 2012

(87) PCT Pub. No.: WO2011/141681

PCT Pub. Date: Nov. 17, 2011

(65) Prior Publication Data

US 2012/0124725 A1 May 24, 2012

(30) Foreign Application Priority Data

May 12, 2010 (FR) ..... 10 53751

(51) Int. Cl.
*E03D 9/10* (2006.01)
*B02C 18/00* (2006.01)

(52) U.S. Cl.
CPC ..... *B02C 18/0092* (2013.01); *E03D 9/10* (2013.01)

(58) Field of Classification Search
CPC ..... E03D 9/10; E03D 11/11; B02C 18/0092
USPC ..... 4/319, 320, 321
See application file for complete search history.

(56) References Cited

U.S. PATENT DOCUMENTS 7,203,976 B1 * 4/2007 Weller et al. ..... 4/321
8,769,730 B2 * 7/2014 Pohler et al. ..... 4/319

FOREIGN PATENT DOCUMENTS

| | | |
|---|---|---|
| FR | 2833979 | 6/2003 |
| FR | 2857390 | 1/2005 |
| GB | 2445036 | 6/2008 |
| JP | 2002364040 | 12/2002 |

OTHER PUBLICATIONS

International search report dated Nov. 8, 2011 in corresponding PCT/FR2011051068.

* cited by examiner

*Primary Examiner* — Tuan N Nguyen
(74) *Attorney, Agent, or Firm* — Young & Thompson

(57) ABSTRACT

A macerator device intended to be connected to a WC bowl, includes a tank (1) into which are brought the water and the matter from the WC bowl and in which is placed a motor (3) equipped on its top part with a dilaceration element (5) included in a basket (4) and at its bottom part with a pump (7), the motor connected to a capacitor (12) and to a microswitch (11) being started up by a pressure sensitive switch controlling the microswitch, macerator device in which a control module (10) is situated under an access hatch provided in the lid (2) of the tank and sealed by a removable cover and the microswitch and the capacitor are accessible at the top part of the control module and/or the motor/pump/dilaceration element assembly is situated under an access hatch provided in the lid and sealed by a removable cover.

18 Claims, 8 Drawing Sheets

Technique antérieure

MACERATOR DEVICE INTENDED TO BE CONNECTED TO A WC BOWL

BACKGROUND OF THE INVENTION

The present invention relates generally to macerators for toilet or WC devices, said macerators being used to dilacerate solid matter and to allow for the outlet of the WCs through small diameter piping.

DESCRIPTION OF THE RELATED ART

As is known per se, such a device comprises a tank into which is poured the content of the WC bowl when flushing the system and into which is also poured, in certain cases, the outlet from a wash basin and/or from a shower or from a bath tub. An evacuation pump sucks the content of the tank through a dilaceration means placed at the bottom of a basket and discharges it toward the evacuation piping. The dilaceration means is generally a cutter revolving in front of a grill. A pressure switch is used to detect the water level in the tank in order to start up the evacuation pump, via a microswitch, when the tank has to be emptied.

The problem encountered with such devices is that of their repair when the tank evacuates badly. An evacuation fault has three main causes: a fault with the pump motor power supply which is provided by a capacitor, a pump motor failure of the microswitch, or clogging of matter around the dilaceration cutter preventing it from revolving.

It is then necessary to have access to the capacitor, to the microswitch and/or to the dilaceration means.

Numerous arrangements have been proposed since these devices have been in existence. Originally the pump motor and its electric power supply were placed outside the tank while the pump and the dilaceration means were at the bottom of the tank. Servicing in case of failures of the electrical power supply or of the motor was easy but offered little safety, particularly for children. The access to the bottom of the tank to repair the pump or the dilaceration cutter was not easy and the assembly was rather unattractive.

In the more recent devices, a motor/pump/dilaceration means assembly is made watertight and positioned in the tank, waterproof power supply wires passing through the wall of the tank to connect the motor to the power supply circuit. Similarly, the microswitch and the capacitor are housed in the pressure switch whose interior can be accessed only via the membrane of the pressure switch which is naturally placed at its bottom part. In order to further improve the safety of the assembly, a lid is secured to the tank by strong snap-fitting means.

The drawback with such a device is that it requires servicing by a professional for any repair, the assembly housed behind the WC bowl being barely accessible and requiring some experience to unclick the lid.

SUMMARY OF THE INVENTION

The present invention proposes a macerator device arranged so as to allow for easy maintenance, possibly by a nonprofessional, in the case of the more commonplace breakdowns of this appliance.

To this end, the invention provides a macerator device intended to be connected to a WC bowl, which consists of a tank into which are brought the water and the matter from said WC bowl and in which is placed a motor equipped on its top part with a dilaceration means included in a basket and at its bottom part with a pump, said motor connected to a capacitor and a microswitch being started up by a pressure sensitive switch controlling the microswitch, and the microswitch/capacitor/pressure switch assembly forming a control module, which control module is situated under an access hatch provided in the lid of said tank and sealed by a removable cover, the microswitch and the capacitor being accessible at the top part of the control module, and/or the motor/pump/dilaceration means assembly is situated under an access hatch provided in the lid of said tank and sealed by a removable cover.

The macerator device according to the present invention therefore has three embodiments:

1) a first embodiment in which the control module is situated under an access hatch provided in the lid of said tank and sealed by a removable cover, the microswitch and the capacitor being accessible at the top part of the control module
2) a second embodiment in which the motor/pump/dilaceration means assembly is situated under an access hatch provided in the lid of said tank and sealed by a removable cover, and
3) a third embodiment in which the control module is situated under an access hatch provided in the lid of said tank and sealed by a removable cover, the microswitch and the capacitor being accessible at the top part of the control module, and the motor/pump/dilaceration means assembly is situated under an access hatch provided in the lid of said tank and sealed by a removable cover.

In the case of the third embodiment, the microswitch/capacitor/pressure switch assembly forming a control module and the motor/pump/dilaceration means assembly are advantageously arranged in the tank on either side of the link pipe to the WC bowl.

The macerator device may also have the following characteristics

- the access hatch or hatches are defined by a vertical cylindrical skirt including a shoulder and are sealed by a removable cover, for example screwed to the lid of the tank.
- the access hatch to the dilaceration means is fitted with an additional lid mounted in a leaktight manner in said access hatch, for example the additional lid is screwed to the shoulder of the vertical skirt defining said access hatch.
- the control module is equipped at its bottom end with a membrane which, under the pressure of the water rising in the tank, raises a rod which actuates the microswitch placed at the top part of the control module.
- the capacitor is housed in a recess of the control module.

BRIEF DESCRIPTION OF THE DRAWING FIGURES

This makes it possible, by removal of said cover or covers, to access the active parts susceptible to servicing, without dismantling the WC bowl or the snap-fitted lid. The present invention will now be described in detail with reference to the following figures.

In all the figures, the same reference numbers are used to designate identical elements in the prior art and in the present invention.

DETAILED DESCRIPTION OF THE INVENTION

Figure 1A:
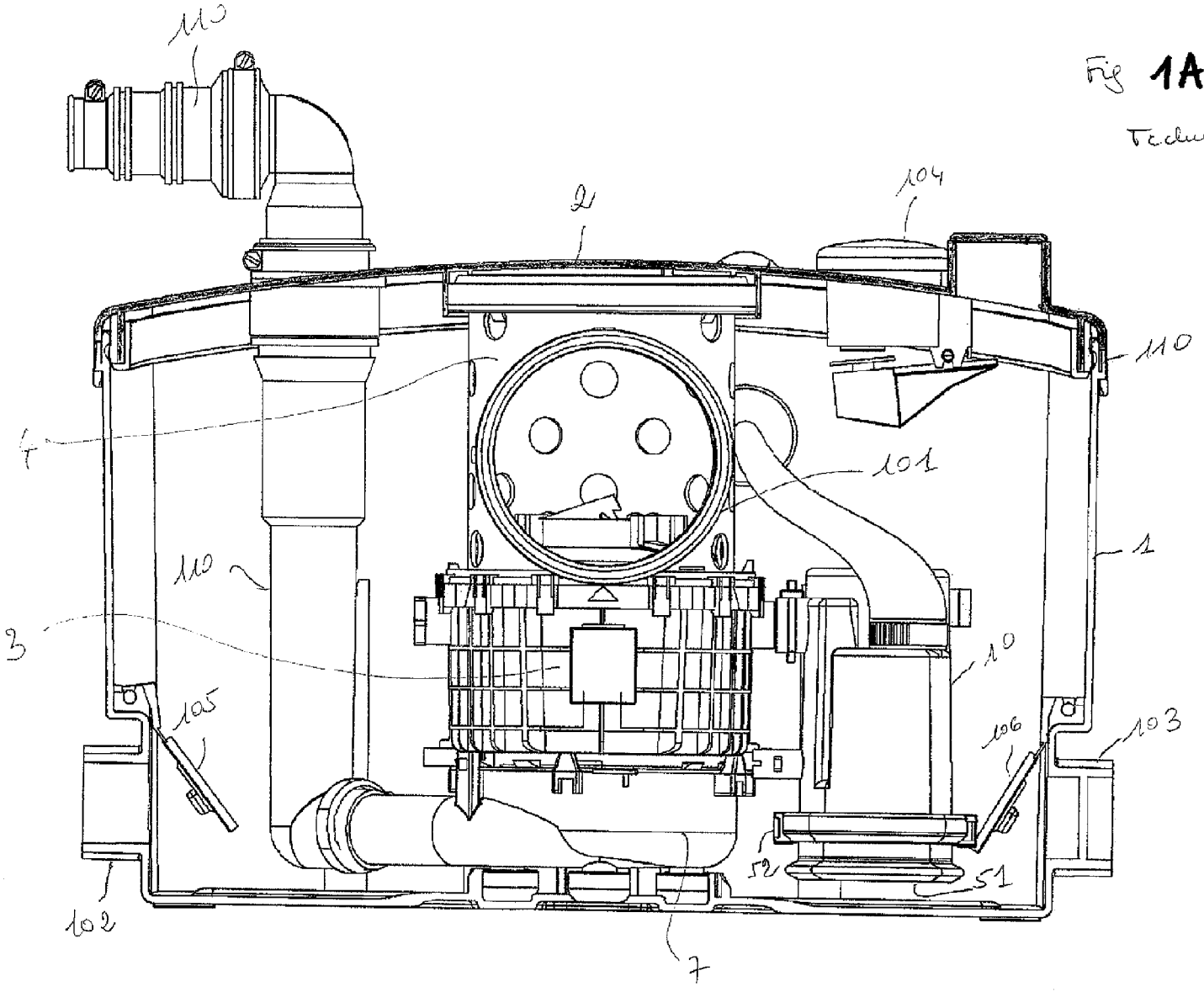
FIGS. 1A and 1B are schematic front and plan views of a macerator device according to the prior art.
Figure 1B:
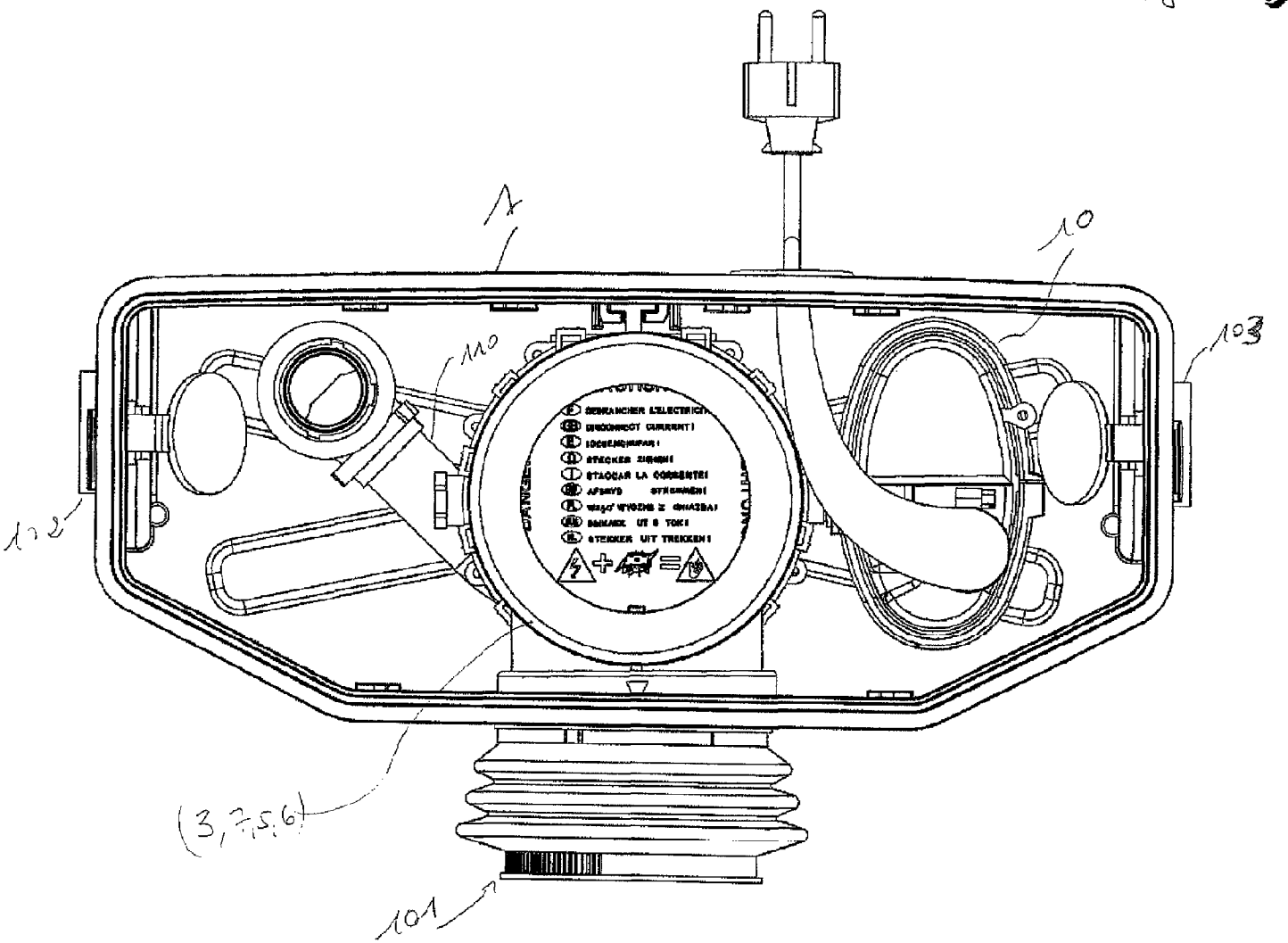
Figure 2A:
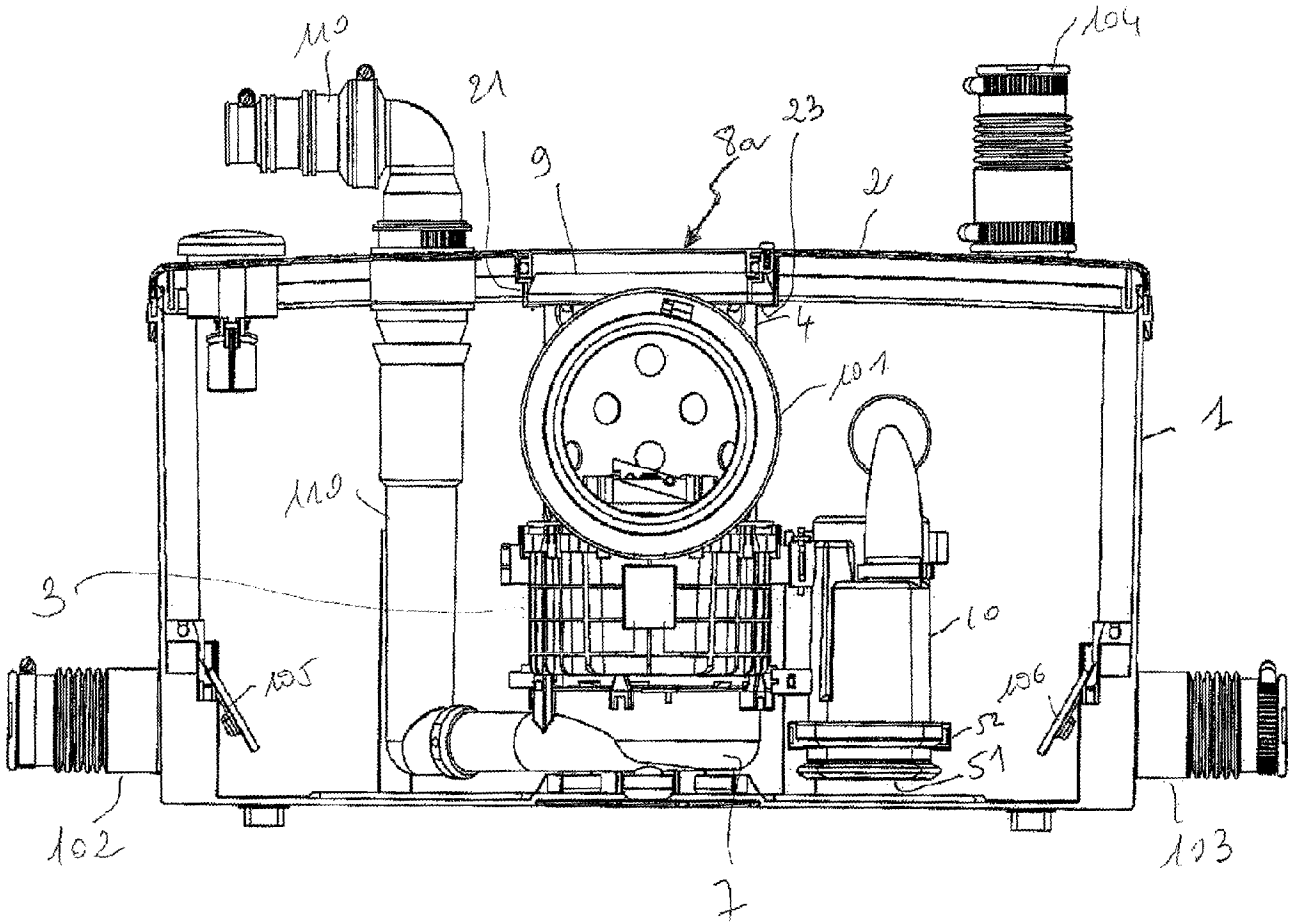
FIG. 2A is a schematic front view of the interior of a macerator device according to the first embodiment of the invention.
Figure 2B:
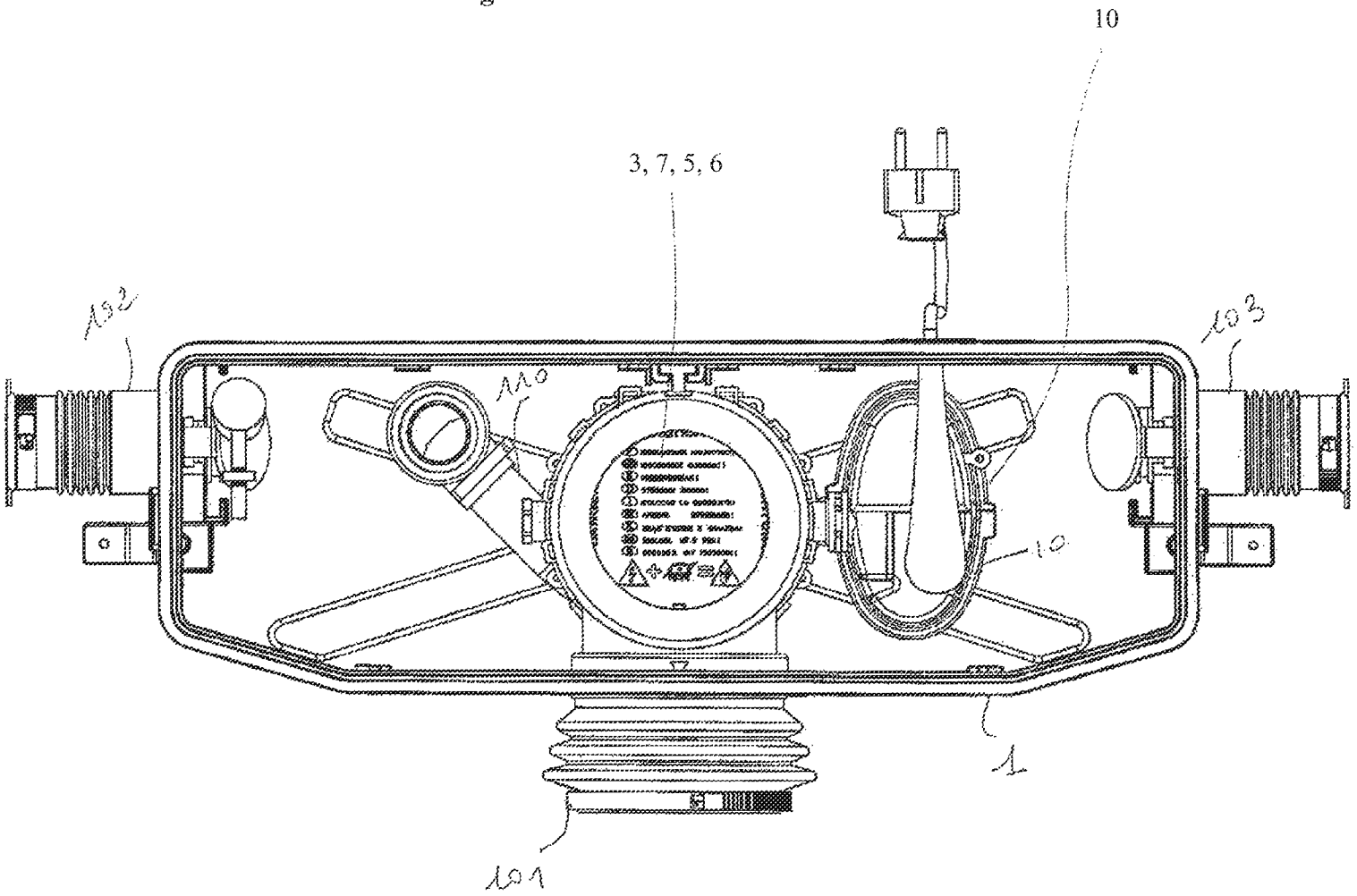
FIG. 2B is a schematic plan view of the interior of the macerator device of FIG. 2A.
Figure 3A:
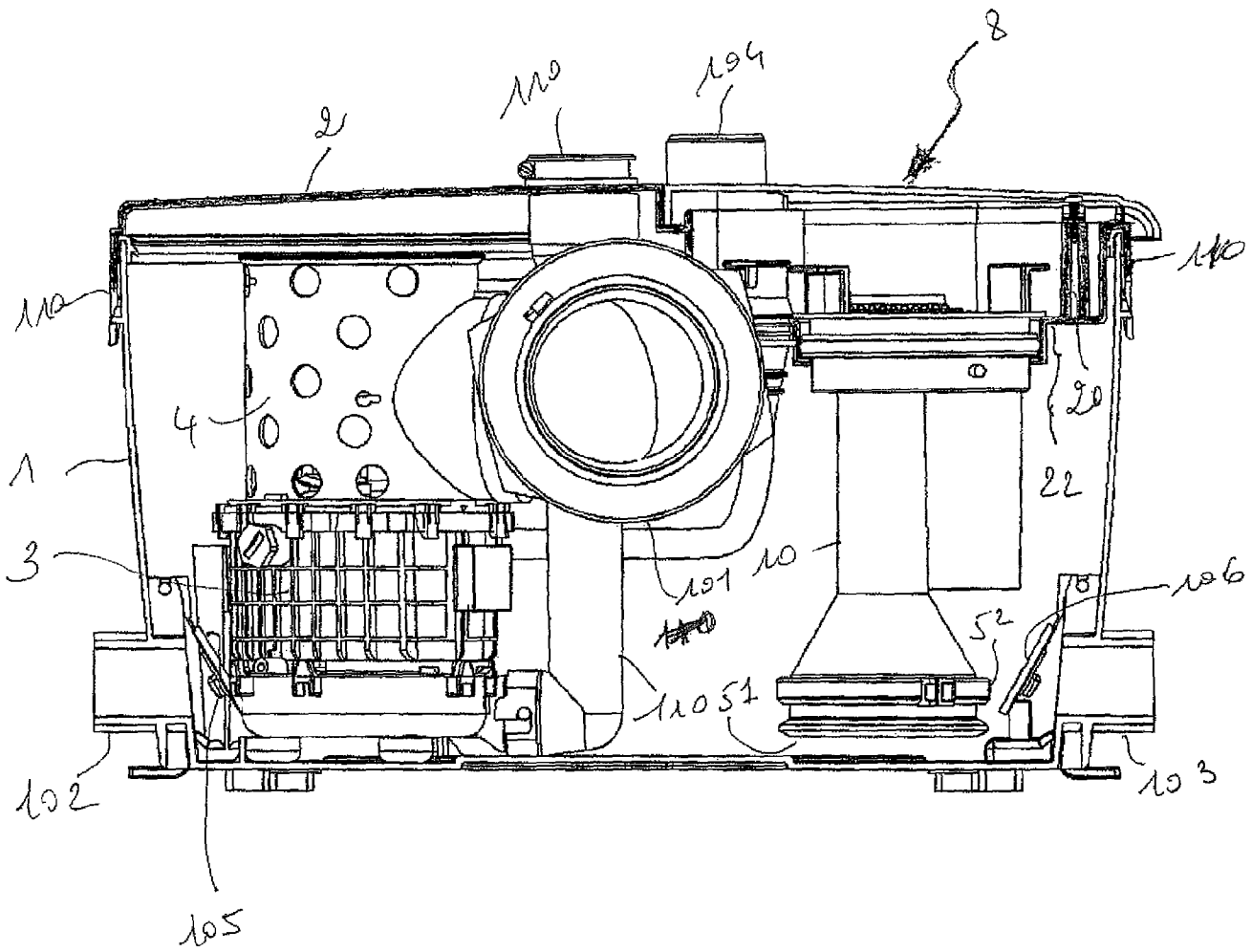
FIG. 3A is a schematic front view of the interior of a macerator device according to the second embodiment of the invention.
Figure 3B:
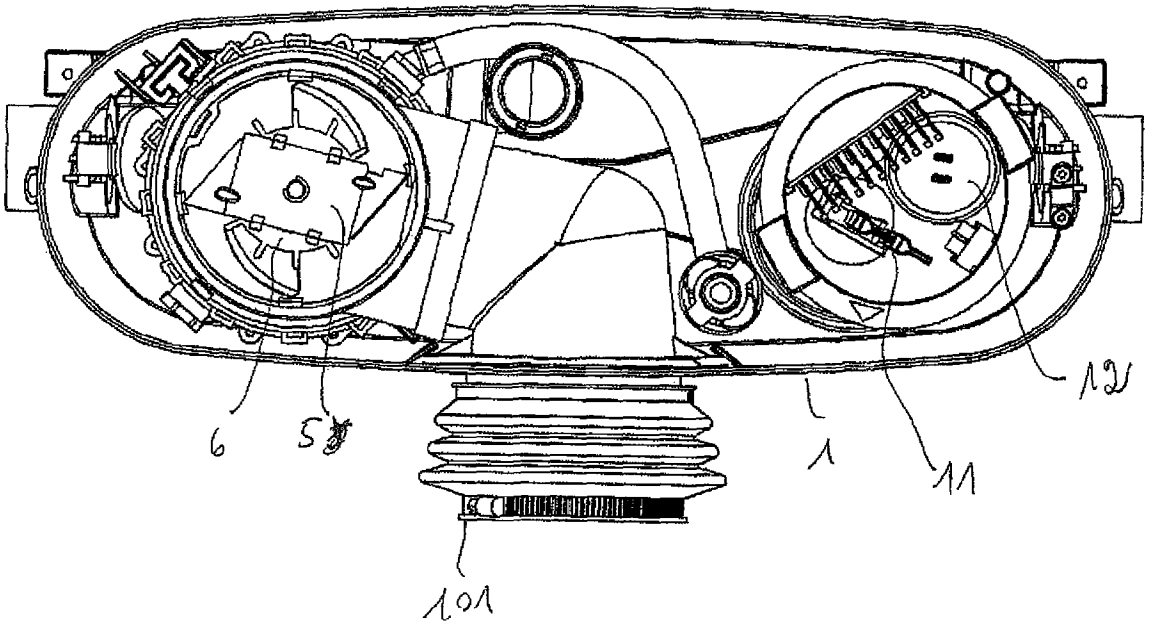
FIG. 3B is a schematic plan view of the interior of the macerator device of FIG. 3A.

In the prior art, the motor/pump/dilaceration means assembly is placed facing the pipe 101 for the arrival of the matter and the water from the WC bowl while the control module is placed to the side. This control module consists of a pressure switch 50 equipped at its bottom part with a membrane 51 which is fixed to the pressure switch by a seal 52 and which, under the pressure of the water rising in the tank, raises a rod which actuates the microswitch contained in the pressure switch and which is not visible in FIGS. 1A and 1B. The motor 3 is also connected to a capacitor housed in the pressure switch 50 and not visible in FIGS. 1A and 1B.

For space-saving reasons, the pressure switch has an elliptical section, which has the effect of making it more difficult to produce the leaktight fixing of the membrane 51 and the fitting of a seal 52 of the same section.

The macerator device according to the present invention comprises a tank 1 of generally parallelepipedal form sealed by a lid 2 attached to the tank 1 by snap-fitting means 110 borne by the tank 1. These snap-fitting means are strong and can be undone generally only by a professional equipped with appropriate tools.

As is known per se, the tank includes a pipe 101 of relatively large dimension for the arrival of the matter and of the water from the WC bowl, a pipe 102 connected to the outlet of a bidet or of a shower, a pipe 103 connected to the outlet of a wash basin and a pipe 104 connected to a controlled mechanical ventilation device.

Figure 4A:
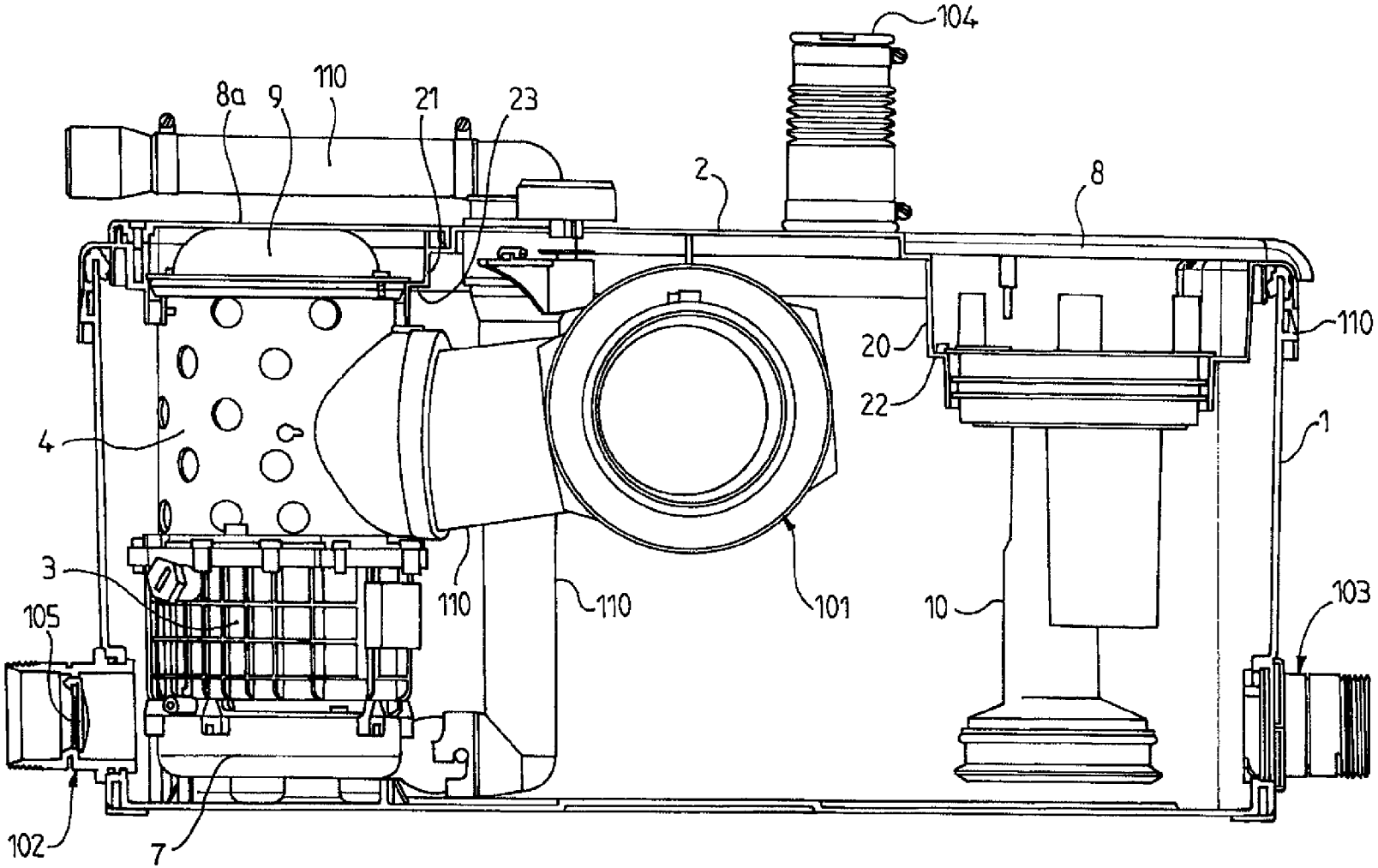
FIG. 4A is a schematic front view of the interior of a macerator device according to the third embodiment of the invention.
Figure 4B:
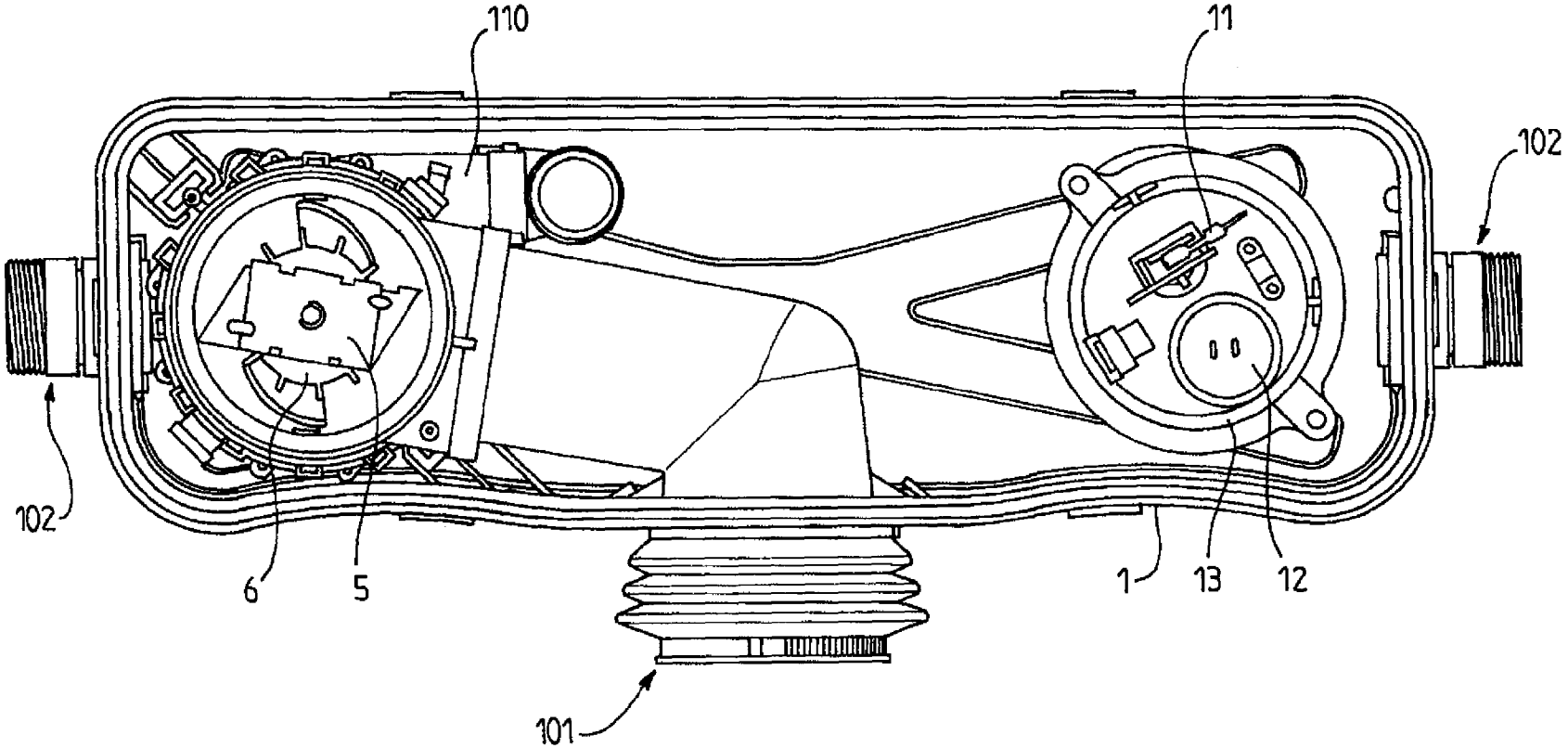
FIG. 4B is a schematic plan view of the interior of the macerator device of FIG. 4A.

There now follows a detailed description of the third embodiment of the invention, by referring to FIGS. 4A and 4B, the first and second embodiments constituting only variants of this third embodiment in which the position of the control module and of the motor/pump/dilaceration means assembly is immaterial although these means are represented in the figures as centered on the link pipe 101 to the WC.

In the case of this embodiment, the control module 10 and the motor/pump/dilaceration means assembly 3, 7, 5, 6 are placed on either side of the link pipe to the WC bowl, which makes it possible to give the pressure switch a cylindrical section and to use the membrane of circular section which is easier to fit and which gives a better leaktightness.

A motor 3 equipped at its base with a pump 7 at the bottom of the tank 1 is placed, for example, to the left of the orifice 101 bringing matter and water and is topped by a perforated basket 4 in the bottom of which is mounted a dilaceration means consisting of a cutter 5 and a centrifuge hub 6. The pump 7 is evacuated via a pipe 110. The electrical links between the outside and the motor are neither represented nor described because they are known to those skilled in the art. Those between the motor and the pump are not represented but will be described later.

A capacitor 12 and a microswitch 11 are placed in a control module 10 to the right of the orifice 101 bringing matter and water.

It is understood that the position of the control module 10 and of the motor/pump/dilaceration means assembly may be reversed without affecting the present invention.

This control module 10 is equipped at its bottom end with a membrane which, under the pressure of the water rising in the tank, raises a rod which moves in a chimney 10A and which actuates the microswitch 11 placed at the top part of the module 10. The motor is also connected to the capacitor 12 placed in a cylindrical housing 13 attached to the chimney 10A of the module 10. The capacitor and microswitch are used to start the motor. The electric wires connecting the microswitch and the capacitor to the motor are housed in a watertight sheath with a length greater than the distance between module and motor so as to enable the module 10 to be removed if necessary from its position defined hereinbelow.

The module 10 is held in place by its positioning under a shoulder 22 of a cylindrical vertical wall 20 defining an access hatch in the lid 2. This access hatch is sealed by a cover 8 fixed by a screw or any other fixing means easy to implement. By removing the cover 8, access to the microswitch 11 and to the capacitor 12 is possible.

The access hatch to the motor/pump/dilaceration means assembly is defined by a cylindrical vertical wall 21 including a shoulder 23. It is sealed by a cover 8*a* fixed by a screw or any other fixing means easy to implement and is also sealed by a lid 9 fixed in a leaktight manner to the shoulder 23 to avoid leaks through the cover 8*a*.

The operation of the system is conventional: when the water from the WC, from the bidet, from the shower or from the wash basin enters into the tank 2, it acts on the membrane which, by rising, actuates the microswitch which starts up the motor. The pump sucks the water and the matter and passes them through the cutter 5 and through the perforated basket 4 and then evacuates them through the pipe 110.

Breakdowns of such a system are mainly of three kinds:

failure of the microswitch 11 failure of the capacitor 12 the presence of an obstruction or of a mass of hair-type matter in the perforated basket 4 preventing the cutter 5 from revolving.

The device according to the third embodiment of the invention makes it possible to have access through the covers 8 and 8*a* to the microswitch 11 and to the capacitor 12 on the one hand and to the perforated basket 4 and to the dilaceration means 5, 6 on the other hand. The devices according to the first and the second embodiments allow access to only one or other of these two assemblies 11, 12 and 4, 5, 6.

Once the cover 8 is open, the user can replace the microswitch 11 or the capacitor 12.

After opening the cover 8*a* and then the lid 9, fixed for example by screwing, respectively to the lid 2 of the tank 1 and the shoulder 23 of the vertical wall 21, the user has access to the basket and can remove an obstruction or the mass of hair-type matter from it.

To avoid injuring the user, the lid 9, for example colored red, is advantageously marked with warnings of the type: "Open only after shutting off the electrical power supply".

According to another characteristic of the invention, the non-return valves 105 and 106 with which the pipes bringing the outlet water from a wash basin and/or from a shower or from a bath tub are provided, are arranged in the inlet pipes 102 and 103, outside the tank 1. Conventionally, the non-return valves of the inlet pipes are arranged at the junction of the tank and of the pipes, inside the tank, and are accessible only from inside the tank. The valves 105 and 106 are mounted in the pipes 102 and 103. In the present invention, the pipes 102 and 103 are short pipes coupled by threaded parts to the outlet pipes from the washbasin and/or from the shower or bath tub (not represented). By dismantling these couplings, the user has access to the non-return valves either to replace them or to remove an object which might obstruct them or jam them in the open or closed position.

The macerator device according to the present invention therefore offers great ease of intervention on the elements which are the cause of the most commonplace breakdowns, without the need for a professional.

The invention claimed is:

1. A macerator device that connects to a WC bowl, comprising:

a tank (1) that receives water and matter from said WC bowl, said tank comprising a lid (2) and first and second access hatches provided in the lid (2);

first and second removable covers (8, 8*a*) that respectively seal each of the first and second access hatches;

a motor (3) located in the tank (1), a top part of the motor being equipped with a dilaceration means (5, 6) included in a basket (4), and a bottom part of the motor being equipped with a pump (7); and a first assembly comprised of a capacitor (12) connected to said motor (3), a microswitch (11) connected to said motor, and a pressure sensitive switch that controls the microswitch to start up the motor, the first assembly of the capacitor, the microswitch, and the pressure sensitive switch forming a control module (10) that cooperates with a second assembly of the motor, the pump, and the dilacerations means, wherein the control module is situated below the first access hatch provided in the lid of said tank and sealed by the first removable cover, and the microswitch and the capacitor are accessible at a top part of the control module, and wherein the second assembly of the motor, the pump, and the dilacerations means is situated below the second access hatch provided in the lid of said tank and sealed by the second removable cover.

2. The device as claimed in claim 1, wherein the control module (10) and the second assembly of the motor, the pump, and the dilacerations means are arranged in the tank (1) on either side of a link pipe (101) to the WC bowl.

3. The macerator device as claimed in claim 1, wherein each access hatch is defined by a vertical cylindrical skirt (20, 21) including a shoulder (22, 23) and is sealed by the respective removable cover (8, 8*a*).

4. The macerator device as claimed in claim 3, wherein each removable cover (8, 8*a*) is screwed to the lid (2) of the tank (1).

5. The macerator device as claimed in claim 1, wherein the second access hatch to the dilaceration means (5, 6) is fitted with an additional lid (9) mounted in a leaktight manner in said second access hatch.

6. The macerator device as claimed in claim 5, wherein the additional lid (9) is screwed to a shoulder (23) of a vertical skirt (21) defining said second access hatch.

7. The macerator device as claimed in claim 1, wherein the module (10) is equipped at a bottom end with a membrane which, under the pressure of water rising in the tank, raises a rod which actuates the microswitch (11) placed at the top part of the control module (10).

8. The macerator device as claimed in claim 7, wherein the capacitor (12) is placed in a cylindrical housing (13) attached to the control module (10).

9. The macerator device as claimed in claim 1, wherein pipes (102, 103) bringing waste waters from a wash basin, from a shower or from a bidet are provided with check valves (105, 106) mounted outside the tank (2).

10. The macerator device as claimed in claim 2, wherein each access hatch is defined by a vertical cylindrical skirt (20, 21) including a shoulder (22, 23) and is sealed by the respective removable cover (8, 8*a*).

11. The macerator device as claimed in claim 10, wherein each removable cover (8, 8*a*) is screwed to the lid (2) of the tank (1).

12. The macerator device as claimed in claim 2, wherein the second access hatch to the dilaceration means (5, 6) is fitted with an additional lid (9) mounted in a leaktight manner in said second access hatch.

13. The macerator device as claimed in claim 2, wherein the module (10) is equipped at a bottom end with a membrane which, under the pressure of water rising in the tank, raises a rod which actuates the microswitch (11) placed at the top part of the control module (10).

14. The macerator device as claimed in claim 13, wherein the capacitor (12) is placed in a cylindrical housing (13) attached to the control module (10).

15. The macerator device as claimed in claim 2, wherein pipes (102, 103) bringing waste waters from a wash basin, from a shower or from a bidet are provided with check valves (105, 106) mounted outside the tank (2).

16. The macerator device as claimed in claim 1, further comprising a link pipe (101) within the tank (1), the link pipe (101) arranged to receive the water and the matter from said WC bowl, wherein the control module (10) is situated below the first access hatch provided in the lid (2) of said tank and sealed by the first removable cover (8) on a first side of the link pipe (101), and wherein each of the motor, the pump, and the dilacerations means (3, 7, 5, 6) is situated below the second access hatch provided in the lid (2) of said tank and sealed by the second removable cover (8*a*) on an opposite, second side of the link pipe (101).

17. A macerator device that connects to a WC bowl, comprising:

a tank (1) comprising a lid (2) and first and second access hatches provided in the lid (2);

first and second removable covers (8, 8*a*) that respectively seal each of the first and second access hatches;

a link pipe (101) within the tank (1), the link pipe (101) arranged to receive water and matter from said WC bowl;

a motor (3) within the tank (1), the motor being equipped with a dilaceration means (5, 6) and a pump (7); and a control module (10) comprised of a capacitor (12) connected to said motor, and a microswitch (11) connected to said motor, the control module (10) starting up the motor, and cooperating with a second assembly of the motor, the pump, and the dilacerations means, wherein the control module is situated below the first access hatch and is accessible by removing the first removable cover so that the microswitch and the capacitor are accessible at a top part of the control module, and wherein the second assembly of the motor, the pump, and the dilacerations means is situated below the second access hatch and the dilacerations means is accessible by removing the second removable cover.

18. The macerator device as claimed in claim 17, wherein, the control module is situated on a first side of the link pipe, and each of the motor, the pump, and the dilacerations means is situated on an opposite, second side of the link pipe.

* * * * *